US008511042B2

(12) United States Patent
Christensen

(10) Patent No.: US 8,511,042 B2
(45) Date of Patent: Aug. 20, 2013

(54) METHODS FOR CONSTRUCTING ICE STRUCTURES

(76) Inventor: Brent R. Christensen, Midway, UT (US)

( * ) Notice: Subject to any disclaimer, the term of this patent is extended or adjusted under 35 U.S.C. 154(b) by 161 days.

(21) Appl. No.: 12/987,210

(22) Filed: Jan. 10, 2011

(65) Prior Publication Data

US 2012/0177446 A1 Jul. 12, 2012

(51) Int. Cl.
*E04B 1/00* (2006.01)

(52) U.S. Cl.
USPC ..... 52/750

(58) Field of Classification Search
USPC ..... 405/217; 52/173.1, 741.1, 745.17, 52/745.19, 750
See application file for complete search history.

(56) References Cited

PUBLICATIONS

Christensen, Midway Ice Castles, http://brentsicecastle.blogspot.com/2009/12/first-day-of-brents-ice-castle-at, Dec. 8, 2009.*

Jeffries, Resident Creates Own Ice Castle, http://www.heraldextra.com/news/local/article_5cf239e2-1356-5096-a4c3-9dcb65c3dec9, Jan. 28, 2009.*

141 Foot Ice Cube—"Fox Icescraper", www.joe-ks.com?archives_mar2005/141ftIceCube.htm, Mar. 2, 2005.*

The Ice Castles at Silverthorne, http://www.icecastles.com/category/how-is-it-grown/, Dec. 9, 2009.*

Life in the Fast Lane, http://www.lifeinthefastlane.ca/natures-spectacular-geometry-of-snowflakes-frost-and-ice/weird-science, Jan. 8, 2009.*

* cited by examiner

*Primary Examiner* — William Gilbert
*Assistant Examiner* — Gisele Ford
(74) *Attorney, Agent, or Firm* — Kirton | McConkie; Michael F. Krieger

(57) ABSTRACT

A method for constructing a structure from ice in a low-temperature environment includes providing a plurality of icicles and attaching icicles to each other to form a framework of icicles. Additional ice is grown on the framework, and then the steps of providing icicles, attaching icicles to each other and to the existing framework, and growing additional ice on the framework are repeated as needed until the structure is completed.

20 Claims, 6 Drawing Sheets

METHODS FOR CONSTRUCTING ICE STRUCTURES

BACKGROUND OF THE INVENTION

1. Field of the Invention

The present invention relates to ice structures, and more particularly to methods for constructing structures of ice in a low-temperature environment.

2. Background and Related Art

In low-temperature environments, structures made out of ice or snow have become common for a variety of purposes. Structures such as snow caves and igloos have long been used for purposes of shelter from the cold. More recently, ice structures have become popular for destination and/or novelty lodging (e.g. ice hotels and ice palaces) as well as for decorative and artistic purposes. Such structures are formed by cutting or carving blocks out of ice or snow and then stacking or otherwise placing the blocks to form the structure. An alternative method is to make a large pile of snow and to carve the structure out of the pile, as with a snow cave. All such structures are limited in their artistic and functional characteristics by the manner in which they are constructed.

BRIEF SUMMARY OF THE INVENTION

A method for constructing a structure from ice in a low-temperature environment includes providing a plurality of icicles and attaching icicles to each other to form a framework of icicles. Additional ice is grown on the framework, and then the steps of providing icicles, attaching icicles to each other and to the existing framework, and growing additional ice on the framework are repeated as needed until the structure is completed.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

In the specification and in the claims, the phrase "low-temperature" means a temperature at which liquid water is converted to solid ice by freezing.

Embodiments of the invention provide a method for constructing a structure from ice in a low-temperature environment includes providing a plurality of icicles and attaching icicles to each other to form a framework of icicles. Additional ice is grown on the framework, and then the steps of providing icicles, attaching icicles to each other and to the existing framework, and growing additional ice on the framework are repeated as needed until the structure is completed.

Figure 1:
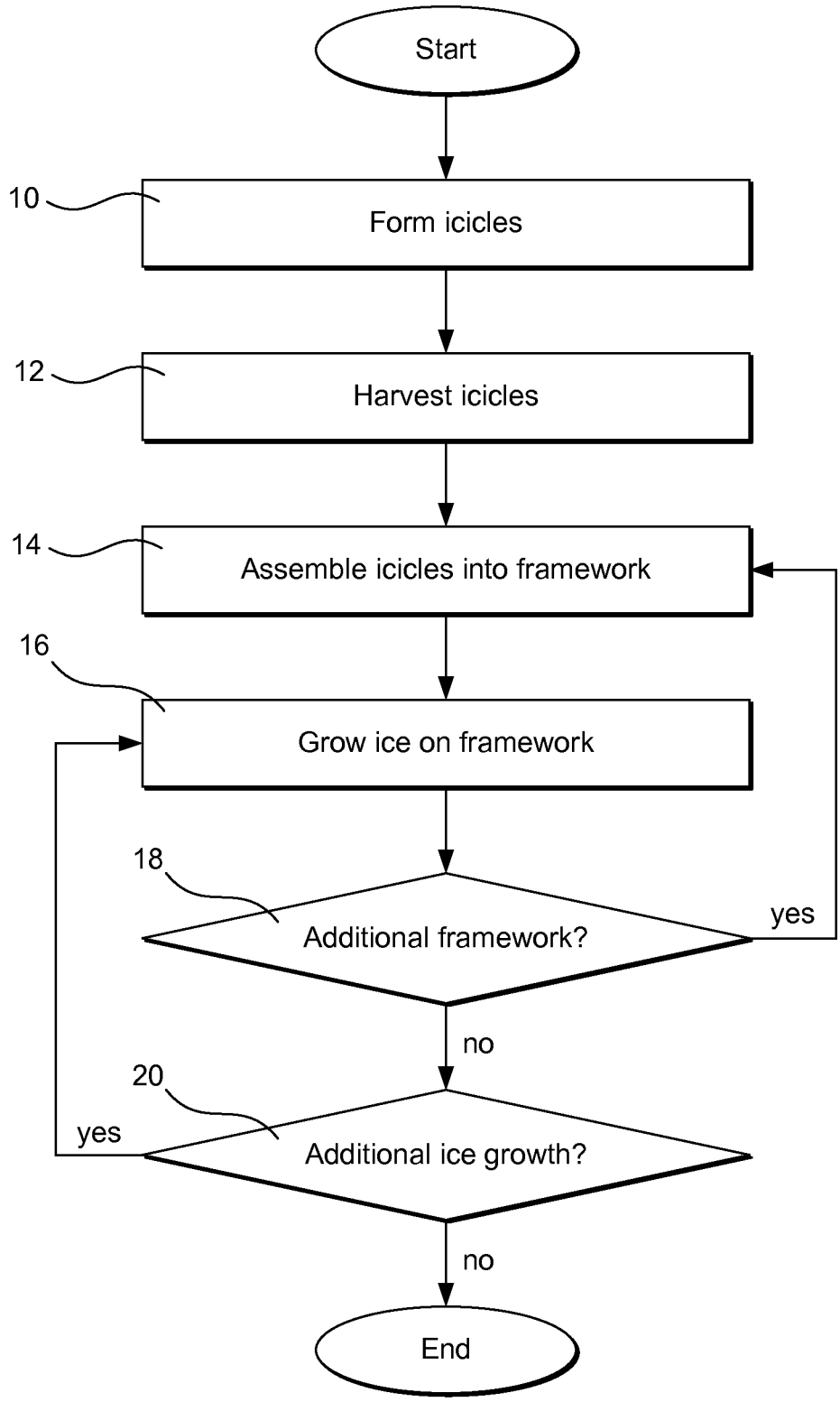
FIG. 1 shows a flowchart illustrating methods in accordance with embodiments of the invention.

A method according to certain embodiments of the invention is illustrated in flowchart form in FIG. 1, with the steps shown in FIG. 1 being described in more detail with reference to later Figures. Execution of the method begins at step 10, with the formation of icicles for use in building a structure. Formation of icicles may occur in a variety of fashions, as will be discussed in more detail below, and may even occur naturally. At step 12, icicles are harvested and shaped or sized, if necessary, for use in constructing a framework of the structure. At step 14, the icicles are assembled into a layer of the framework of the structure. At step 16, ice is grown on the framework, at least partially filling in spaces in the framework.

At decision block 18, a determination is made as to whether to add additional layers of framework to the structure. If additional layers of framework are to be added, execution loops back to step 14. If additional layers of framework are not to be added, execution proceeds to decision block 20, where a determination is made as to whether to grow additional ice on the existing framework. If additional ice is to be grown, execution loops back to step 16. If no additional ice is to be grown on the structure, execution may end, although the method may be re-started at any time as needed or desired. Additionally, though not specifically illustrated in FIG. 1, steps 10 and 12 relating to the growing and harvesting of icicles may be continued as needed to supply icicles for the framework of the structure.

Figure 2:
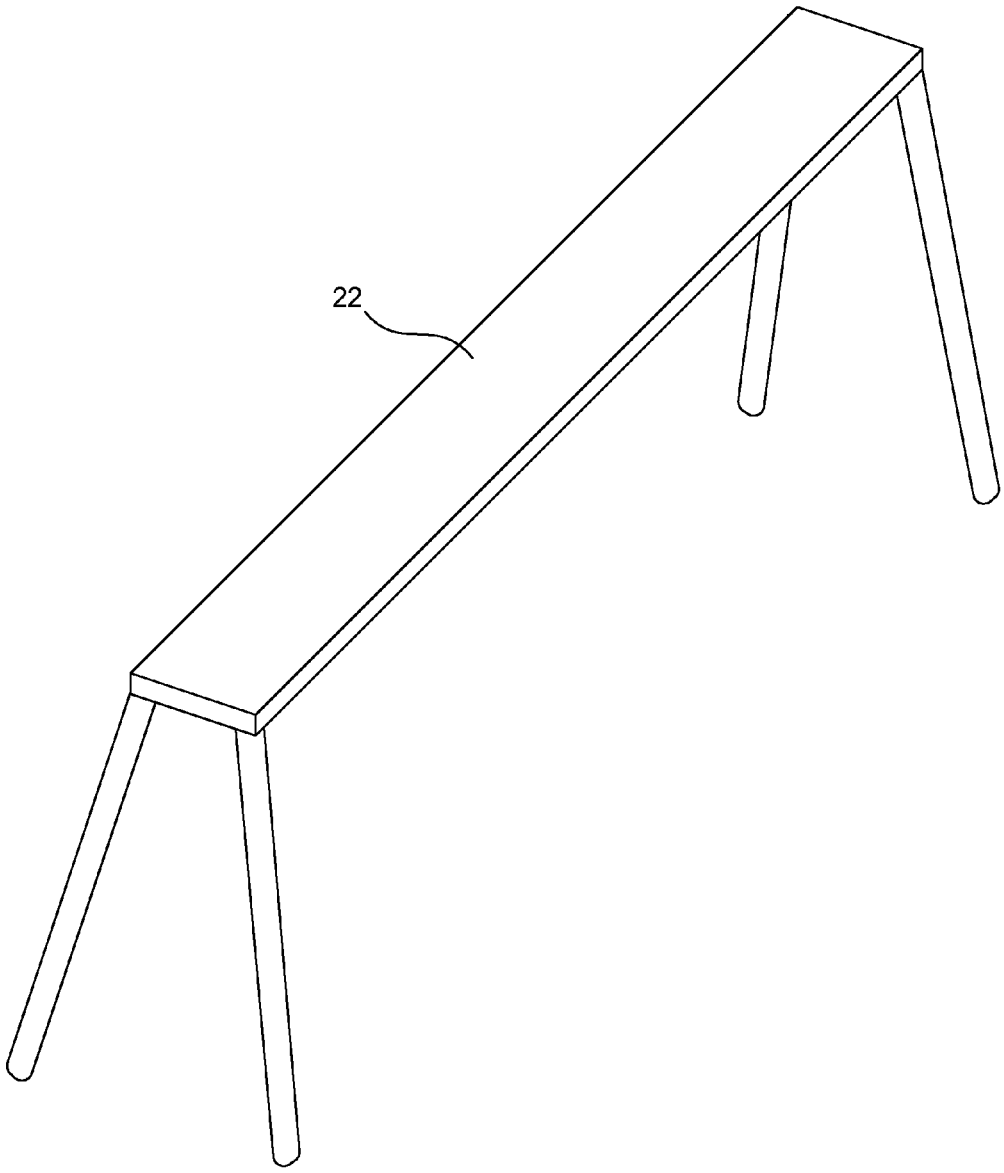
FIG. 2 shows a perspective view of a plank used for forming icicles.
Figure 3:
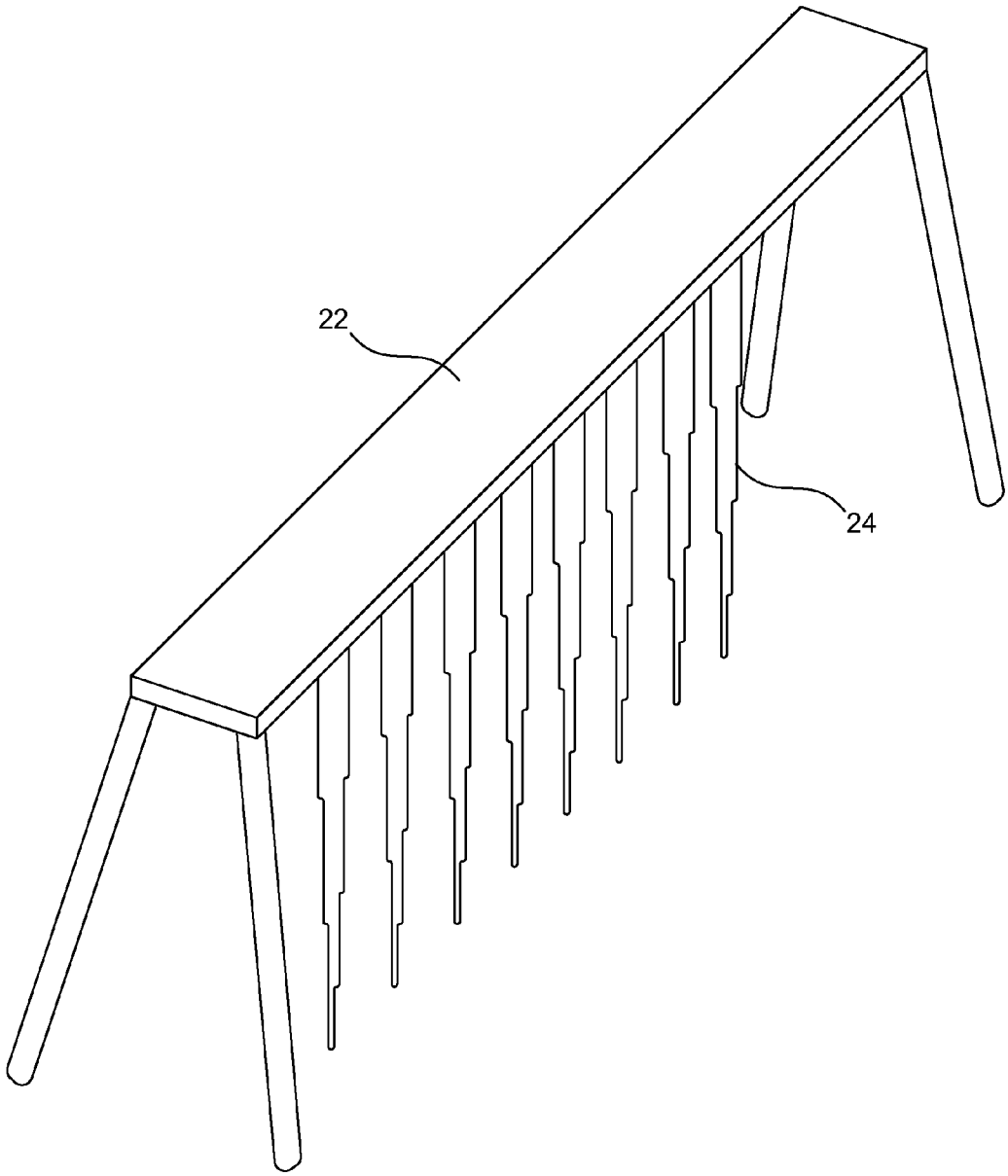
FIG. 3 shows a perspective view of a plank with some icicles formed thereon.

As described with respect to step 10 above, icicles may be formed in any of a variety of fashions, including natural icicle growth. However, to provide sufficient quantities of icicles, one method of growing icicles for use in building structures is illustrated with reference to FIGS. 2 and 3. In this method, a plank 22 or other supporting structure as shown in FIG. 2 is elevated above an underlying surface in a low-temperature environment. The plank 22 may have a simple geometry, or it may have fluted edges or the like to govern the location of icicle formation. The plank 22 may be elevated on any desired structure, and is elevated to a height at least sufficient to allow growth of icicles of a desired length. A supply of liquid water is delivered to an upper surface of the plank 22, such as by a hose, sprinkler, or the like, either intermittently or continuously. Water is typically delivered at a flow rate that prevents the water from freezing in the delivery system (e.g. hose, sprinkler, etc.), that allows liquid water to flow over at least a portion of the surface of the plank 22, and that causes liquid water to flow over the edges of the plank 22 to freeze into icicles 24 hanging off of the plank 22 as represented in FIG. 3. In FIG. 3, only a few of the icicles 24 have been illustrated for simplicity, but it should be understood that icicles 24 may be formed along any portion of the edge of the plank 22 or along the entire edge of the plank 22.

The icicles 24 may be harvested from the plank 22 from time to time as they reach an appropriate or desired size. How long it takes for the icicles to reach a desired size depends on the temperature conditions and the rate at which the water is delivered to the plank, along with any other appropriate factors. Such factors are a matter or routine experimentation and are therefore not addressed further herein.

While varying sizes of icicles 24 may be harvested from the plank 22 from time to time, at least some of the icicles 24 that are harvested may be longer than is necessary or desired for a particular application in the framework of the structure. Therefore, some or all of the icicles 24 that have been harvested may be sized or shaped for inclusion in the framework. This may be achieved by cutting or breaking the icicles to desired lengths.

Figure 4:
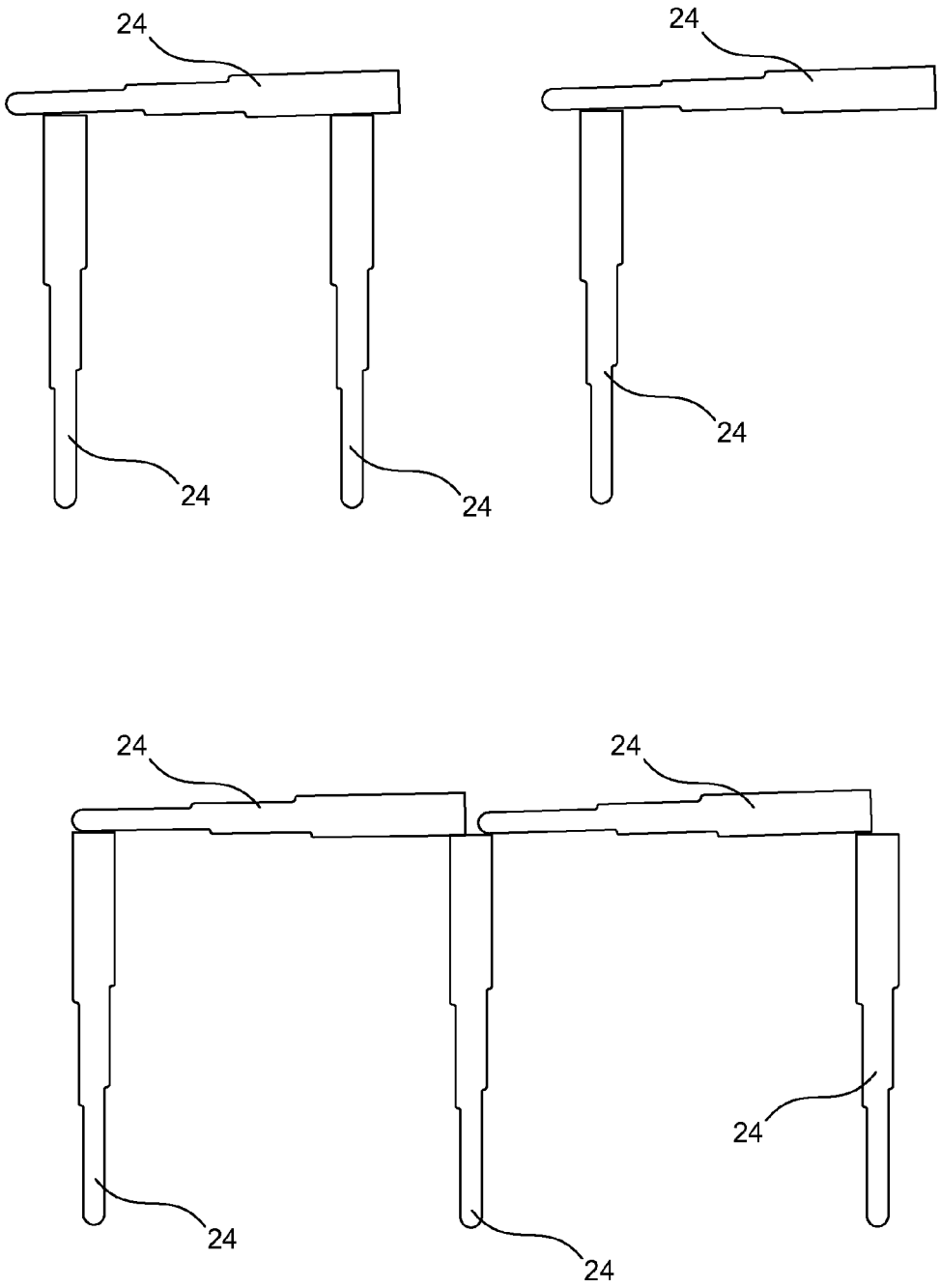
FIG. 4 shows various illustrative plan views of ways in which icicles can be connected together to form a framework for a layer of an ice structure.

The icicles 24 are assembled into a layer of the framework in a low-temperature environment. Icicles 24 are joined one to another to form a framework using a slush of ice in liquid water. In the low-temperature environment and between two icicles 24, the slush quickly and almost instantaneously freezes the two icicles 24 together. The slush may be applied by a user wearing a heavy-duty rubber glove or the like, and may be applied to one surface of an icicle 24 where another icicle 24 is to be attached. The other icicle 24 is then quickly applied to that location in a desired position and orientation, thus forming a framework element. Because of the rapidly-formed and strong joint between the icicles 24 provided by the freezing slush, a wide variety of framework elements may be formed, as illustrated in FIG. 4. Such framework elements provide for almost limitless shapes of final structures, each readily formed using the framework elements.

Figure 5:
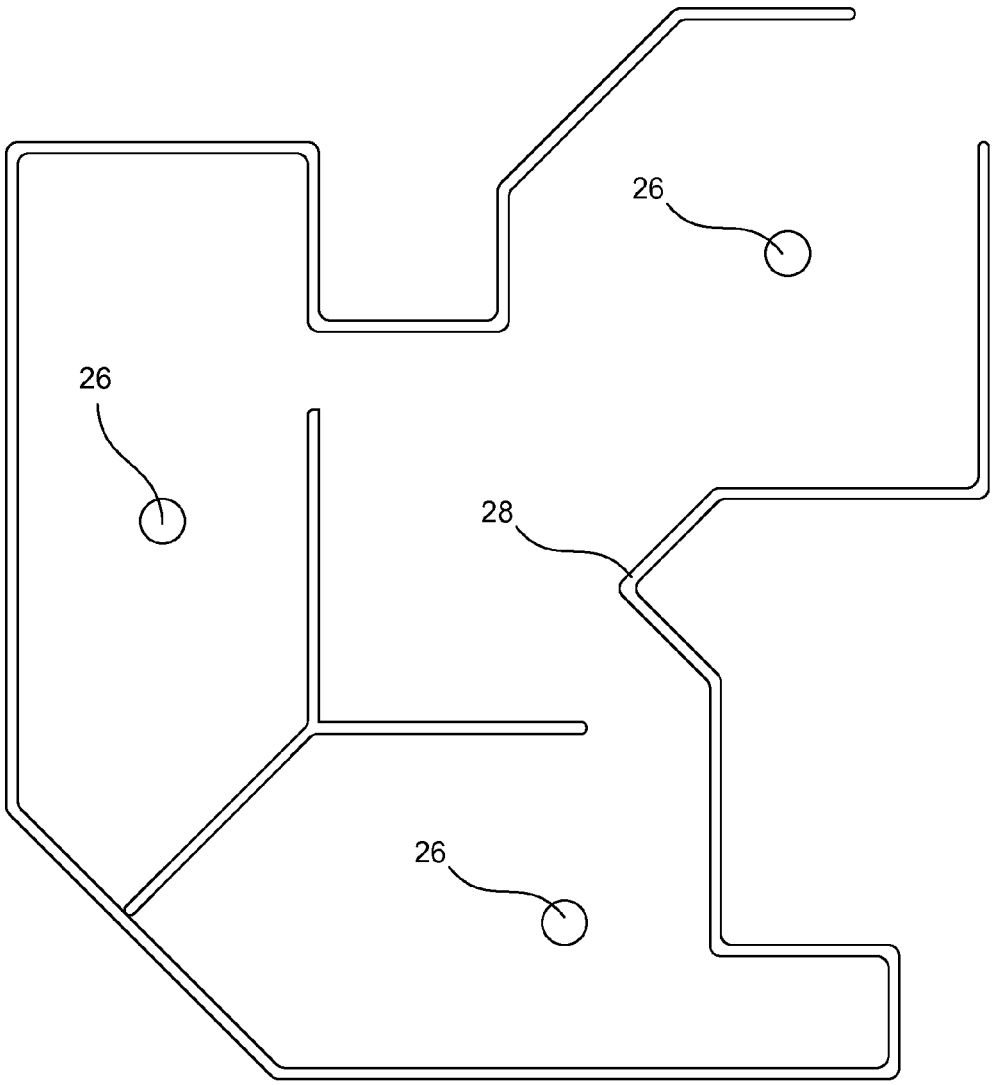
FIG. 5 shows an overhead view of a structure layout and placement of sprinklers therein for growth of the structure.

For example, in one type of construction, a layer of the framework includes a plurality of vertically-disposed icicles 24, with horizontally-disposed icicles 24 affixed on top of the vertically-disposed icicles 24, as shown in FIG. 4. Because of the immediate strength of the frozen connections between icicles 24, even cantilevered designs (as shown in the upper right of FIG. 4) may be provided in addition to designs with more than one vertically-disposed icicle 24 per horizontally-disposed icicle 24 (as shown in the upper left of FIG. 4). While more than one layer of the framework may be constructed at a time, in certain embodiments of the invention, only one layer of the framework is formed at a time, and additional ice is grown on each layer before the next layer is constructed. Additional ice is grown on each layer using one or more sprinklers 26 that are strategically placed within the growing ice structure, as is illustrated in FIG. 5, which shows an overhead view of a framework layout 28. The sprinkler 26 or sprinklers 26 may be placed according to a variety of factors, and are placed so as to cover areas of the layout where ice growth is desired. Growing ice on a layer of the framework at a time may result in more even growth as additional layers are added to the construction.

Liquid water is delivered to the sprinkler 26 or sprinklers 26 at a temperature and flow rate that allows the water to flow through the sprinkler 26 or sprinklers 26 without freezing in the delivery pipes/hoses or in the sprinkler, and that allows the water to freeze to the framework at a desirable rate so as to allow controlled growth of the ice on the framework. As the water temperature and flow rate are somewhat dependent on the external conditions (air temperature, humidity, area being sprinkled, etc.), it is impossible to describe any particular flow rate and water temperature, but it is a matter of routine experimentation to achieve conditions that favor a desired type of growth. Water may be delivered to the sprinkler 26 or sprinklers 26 in a substantially-continuous fashion or intermittently to allow sufficient time for freezing on the framework. If, however, water flow to the sprinklers is to be interrupted, precaution should be taken to prevent freezing of the water in the sprinkler 26 or sprinklers 26, or in any supply lines. Compressed air may be used to clean the system between times of water delivery, the system may be otherwise evacuated of water, or continuous low flows of water may be supplied to the system in between periods of higher flow.

Figure 6:
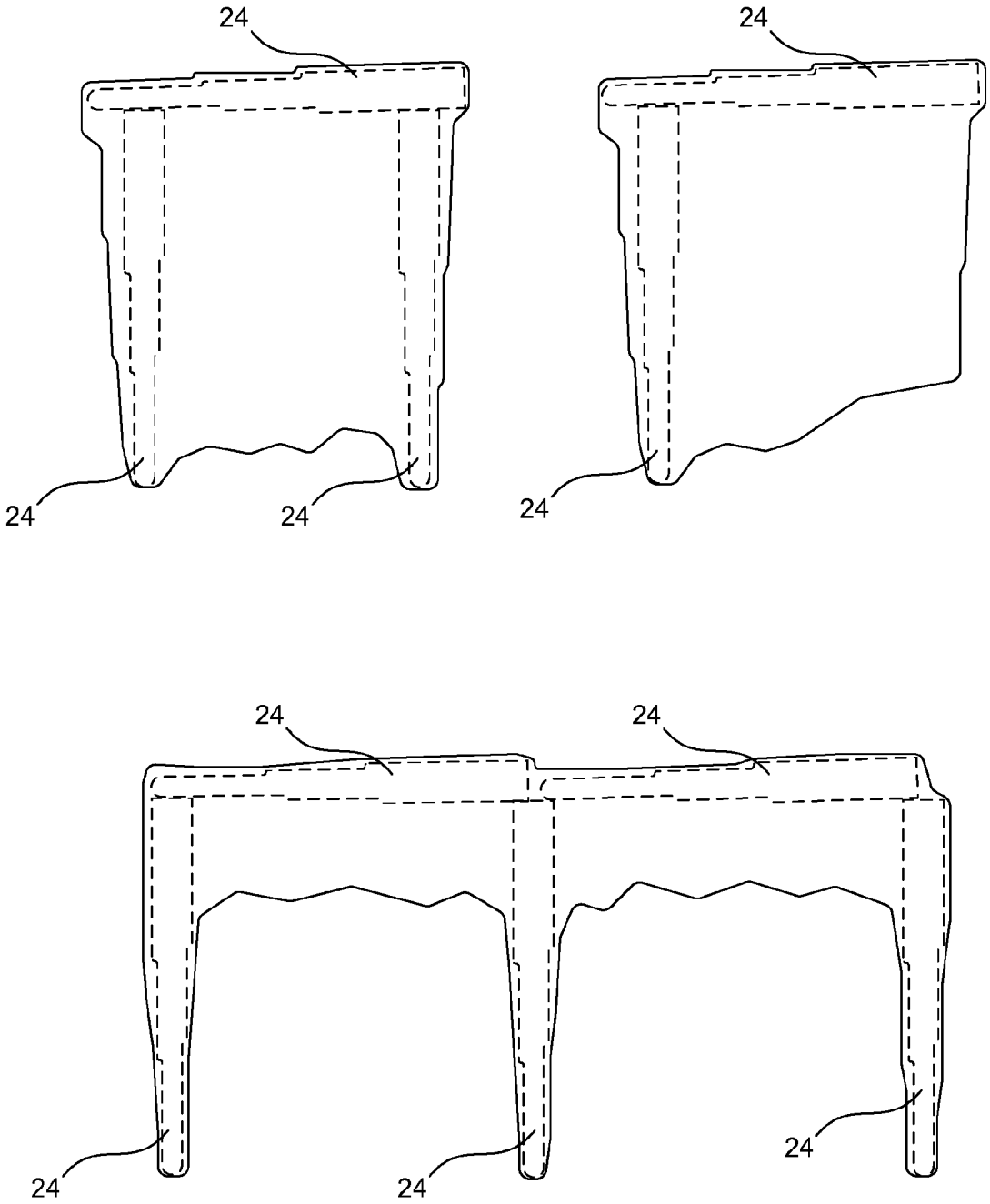
FIG. 6 shows plan views of ways in which ice growth can occur on a framework of icicles.

Ice grows on the framework in an organic fashion that is both functional and beautiful. While existing carved ice and snow structures commonly have hard lines, the naturally-organic growth of the ice on the framework, as illustrated in FIG. 6 provides a kind of beauty not commonly seen in existing structures (except potentially during melting phases) while still providing structural strength. In FIG. 6, the underlying original icicles 24 are shown in dotted lines, along with the ice formed onto the framework of the icicles 24. In the upper two examples shown in FIG. 6, ice has grown in to nearly fill the space between the icicles 24, and additional application of water could result in completely filling in the space between the icicles 24. In the lower example, ice has only grown in to a lesser extent. The extent to which the ice is grown on the framework may be a matter of choice of the maker of the structure, and may vary by layers and areas of the structure.

After a desired amount of ice growth has been achieved on one layer of the structure and framework, an additional layer of the framework of the structure may be assembled in a fashion similar to that discussed above. Vertically-disposed icicles 24 are attached to the existing layer of structure, and horizontally-disposed icicles 24 are attached on top of the new vertically-disposed icicles 24. The attachment is made using the same process as previously described. The new layer of framework may have, but need not have, the same pattern or footprint of previous layers, allowing for the formation of complex building structures as the ice structure is formed. As each layer is raised up, the sprinkler 26 or sprinklers 26 may also be raised up to facilitate growth of ice on each new layer. The construction method allows the formation of walls, passages, roofs, domes, windows, doorways, and essentially any other structure.

Building of the structure may proceed at whatever pace the ambient temperatures permit. In some instances, for example, a single layer of the structure may be built per day. In other examples, multiple layers of the structure may be built in a single day. With sufficient time, structures of almost any size may be constructed using methods similar to those discussed herein.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A method for constructing a structure from ice in a low-temperature environment, the method comprising:

providing a plurality of icicles;

attaching icicles to each other to form a framework of icicles, the framework having spaces therein, wherein the icicles are attached to each other by:

applying a slush mixture of ice and water to at least a first of two icicles to be attached to each other, the first icicle being vertically positioned;

contacting a desired portion of the second of the two icicles to the first icicle at a location where the slush was applied, the second icicle being positioned perpendicularly to the first icicle; and maintaining a relationship between the second icicle to the first icicle until the slush mixture is sufficiently frozen to secure the two icicles to each other;

growing additional ice on the framework; and repeating the steps of providing icicles, attaching icicles to each other and to the existing framework, and growing additional ice on the framework until the structure is completed.

2. A method as recited in claim 1, wherein providing a plurality of icicles comprises:

growing icicles from an elevated structure in a low-temperature environment; and sizing the icicles to a size appropriate for inclusion in the framework.

3. A method as recited in claim 2, wherein growing icicles from the elevated support structure comprises delivering water to the elevated support structure at a temperature and flow rate designed to permit growth of the icicles from the elevated support structure in the low-temperature environment.

4. A method as recited in claim 1, wherein providing the plurality of icicles comprises harvesting natural icicles.

5. A method as recited in claim 1, wherein attaching icicles to each other to form a framework of icicles further comprises attaching the second icicle to a third icicle by:

applying a slush mixture of ice and water to the third icicle;

contacting a desired portion of the second icicle to the third icicle at a location where the slush was applied to the third icicle; and maintaining a relationship between the second and third icicles until the slush mixture is sufficiently frozen to secure the two icicles to each other.

6. A method as recited in claim 1, wherein the second icicle is attached to the first icicle in a cantilever configuration.

7. A method as recited in claim 1, wherein growing additional ice on the framework comprises using a sprinkler to spray liquid water on the horizontal second icicle to allow ice to form underneath the second icicle to fill in space below the second icicle.

8. A method as recited in claim 7, wherein multiple sprinklers are used to ensure coverage of the entire framework with sprinkled water.

9. A method as recited in claim 7, wherein the sprinkler is elevated as each new layer of the framework is added.

10. A method for constructing a structure from ice in a low-temperature environment, the method comprising:

growing icicles from an elevated structure in a low-temperature environment;

sizing the icicles to a desired size;

placing a first icicle in a vertical configuration;

placing a second icicle in a vertical configuration at a distance from the first icicle;

attaching a third icicle between the first and second icicles in a horizontal configuration, the third icicle being attached to the first and second icicle by:

applying a slush mixture of ice and water to the first and second icicles;

contacting a desired portion of the third icicle to the location of the first and second icicles where the slush was applied; and maintaining a relationship between the first, second, and third icicles until the slush mixture is sufficiently frozen to secure the icicles to each other, such that a first space is formed below the third icicle and between the first and second icicles;

placing a fourth icicle in a vertical configuration at a distance from the second icicle;

attaching a filth icicle between the second and fourth icicles in a horizontal configuration, the fifth icicle being attached to the second and fourth icicle by:

applying a slush mixture of ice and water to the second and fourth icicles;

contacting a desired portion of the fifth icicle to the location of the second and fourth icicles where the slush was applied; and maintaining a relationship between the second, fourth, and fifth icicles until the slush mixture is sufficiently frozen to secure the icicles to each other, such that a second space is formed below the fifth icicle and between the second and fourth icicles; and growing additional ice on the icicles to fill in one or more of the first or second space.

11. A method as recited in claim 10, further comprising:

placing a sixth icicle in a vertical configuration on top of one or more of the other icicles;

attaching a seventh icicle to the sixth icicle in a horizontal configuration, the seventh icicle being attached to the sixth icicle by:

applying a slush mixture of ice and water to the sixth icicle;

contacting a desired portion of the seventh icicle to the location of the sixth icicle where the slush was applied: and maintaining a relationship between the sixth and seventh icicles until the slush mixture is sufficiently frozen to secure the icicles to each other; and growing additional ice on the seventh icicle to fill in a space between the seventh icicle and the other icicles below the seventh icicle.

12. A method as recited in claim 10, wherein the additional ice is grown on the seventh icicle by positioning a sprinkler above the seventh icicle.

13. A method as recited in claim 10, wherein additional ice is grown on the icicles to fill in the first space, the method further comprising:

preventing ice from growing in the second space to thereby form a passageway for passing through the second space, elements.

14. A method as recited in claim 10, wherein the first, second, and fourth icicles are placed on the ground.

15. A method as recited in claim 10, wherein the first, second, and fourth icicles are placed on one or more other icicles.

16. A method as recited in claim 10, wherein the first, second, and fourth icicles are positioned so that an angle of around 90 degrees is formed by a line between the first and second icicles and a line between the second and fourth icicles.

17. A method as recited in claim 16, wherein the icicles form a portion of a wall of an enclosed ice structure.

18. A method of building an ice structure using vertically and horizontally placed icicles to form a framework on which ice is grown, the method comprising:

for each of a plurality of layers of the ice structure including a lowest layer, building a framework on which ice is grown, the framework for each layer being built by:

positioning, on the next lowest layer of the ice structure, a plurality of icicles in a vertical orientation;

positioning a plurality of icicles in a horizontal orientation on top of at least some of the vertically oriented icicles; and attaching the plurality of horizontally oriented icicles to the vertically oriented icicles by:

applying a slush mixture of ice and water between the vertically and horizontally oriented icicles; and maintaining a relationship between the vertically and horizontally oriented icicles until the mixture is sufficiently frozen to secure the icicles together; and growing additional ice on the framework.

19. An ice structure as recited in claim 18, wherein additional ice is grown on a first layer of the framework prior to building another layer on top of the first layer of the framework.

20. An ice structure as recited in claim 18, wherein multiple layers of the framework are built prior to growing additional ice on the multiple layers.

* * * * *